US008079791B2

(12) United States Patent
Ness

(10) Patent No.: US 8,079,791 B2
(45) Date of Patent: Dec. 20, 2011

(54) BULK BAG TRANSPORT APPARATUS

(76) Inventor: Daniel W. Ness, Metairie, LA (US)

( * ) Notice: Subject to any disclaimer, the term of this patent is extended or adjusted under 35 U.S.C. 154(b) by 222 days.

(21) Appl. No.: 12/409,161

(22) Filed: Mar. 23, 2009

(65) Prior Publication Data

US 2010/0178126 A1 Jul. 15, 2010

Related U.S. Application Data

(63) Continuation-in-part of application No. 11/531,926, filed on Sep. 14, 2006, now Pat. No. 7,520,707.

(60) Provisional application No. 60/735,448, filed on Nov. 10, 2005.

(51) Int. Cl.
*B65D 88/12* (2006.01)

(52) U.S. Cl. ..... 410/31

(58) Field of Classification Search ..... 410/31, 410/32, 42, 46; 220/1.5, 1.6, 4.01, 4.26, 220/4.27, 23.83, 694
See application file for complete search history.

(56) References Cited

U.S. PATENT DOCUMENTS

| | | | |
|---|---|---|---|
| 3,819,044 | A | 6/1974 | Bockenstette |
| 4,027,796 | A | 6/1977 | Martin |
| 5,335,789 | A | 8/1994 | Taravella et al. |
| 5,507,237 | A | 4/1996 | Barrow et al. |
| 5,555,845 | A | 9/1996 | Flynn |
| 6,041,931 | A | 3/2000 | Jacques |
| 6,357,365 | B1 | 3/2002 | Higgins et al. |
| 7,287,661 | B2 | 10/2007 | Knutsson et al. |
| 7,520,707 | B1 | 4/2009 | Ness |
| 2007/0034627 | A1 | 2/2007 | Wood et al. |
| 2007/0108085 | A1 | 5/2007 | Andrade |

*Primary Examiner* — Hilary Gutman
(74) *Attorney, Agent, or Firm* — Garvey, Smith, Nehrbass & North, L.L.C.; Charles C. Garvey, Jr.; Vanessa M. D'Souza

(57) ABSTRACT

A bulk bag transport apparatus employs a receptacle that is divided into a plurality of bulk bag holding sectors. The receptacle provides a base that is constructed of a plurality of beams such as eye beams including peripheral beams and transverse beams. Each side wall is reinforced with a plurality of inclined beams that preferably join to the transverse bottom beams, one inclined beam attaching to a transverse bottom beam. A plurality of other beams are attached to the upper edge of the receptacle and each inclined beam is structurally joined to a peripheral beam. Lifting eyes are provided along each side of the receptacle, each lifting eye performs an acute angle with an inclined beam and is preferably mounted to an inclined beam. A lifting harness includes slings that can be connected to the lifting eyes. Each side wall has an horizontal flange or a member that enables one of the receptacles to be stacked upon the other of the receptacles wherein the upper peripheral beam of one receptacle engages and supports the horizontal flange or member of another receptacle.

20 Claims, 7 Drawing Sheets

BULK BAG TRANSPORT APPARATUS

CROSS-REFERENCE TO RELATED APPLICATIONS

Priority of U.S. Provisional Patent Application Ser. No. 60/735,448, filed Nov. 10, 2005, incorporated herein by reference, is hereby claimed.

This is a continuation in part of U.S. Ser. No. 11/531,926, filed Sep. 14, 2006, hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the transport of bulk bags with a specially configured receptacle that carries a plurality of bulk bags side by side. Even more particularly, the present invention relates to a new and improved bulk bag transport apparatus that features a receptacle having a plurality of side walls, a bottom wall and an interior with an open top. Doors enable loading with a fork lift.

2. General Background of the Invention

In the drilling and production of oil and gas, many chemicals necessarily must be transported to a drill site which can in many instances be many miles offshore in a marine environment.

The transfer of materials to these remote marine locations can be costly and dangerous. Thus, there is a need for a simple yet effective way to transport materials to oil and gas well drilling and production platforms in an offshore marine environment.

Once a delivery is made to an offshore location, floor space is at a premium. Offshore oil and gas well drilling facilities are quite expensive to construct and there is very little extra space for the storage of supplies. It is to this problem that the present invention is directed.

The present invention provides a bulk bag transport apparatus that includes a receptacle having a plurality of side walls, a bottom wall, an interior and an open top surrounded by an upper edge.

BRIEF SUMMARY OF THE INVENTION

A bulk bag transport apparatus employs a receptacle that is divided into a plurality of bulk bag holding sectors. The receptacle provides a base that is constructed of a plurality of beams such as eye beams including peripheral beams and transverse beams.

Lifting eyes are provided along each side of the receptacle.

Doors can be opened to enable forward loading of bulk bags using a fork lift.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 7:
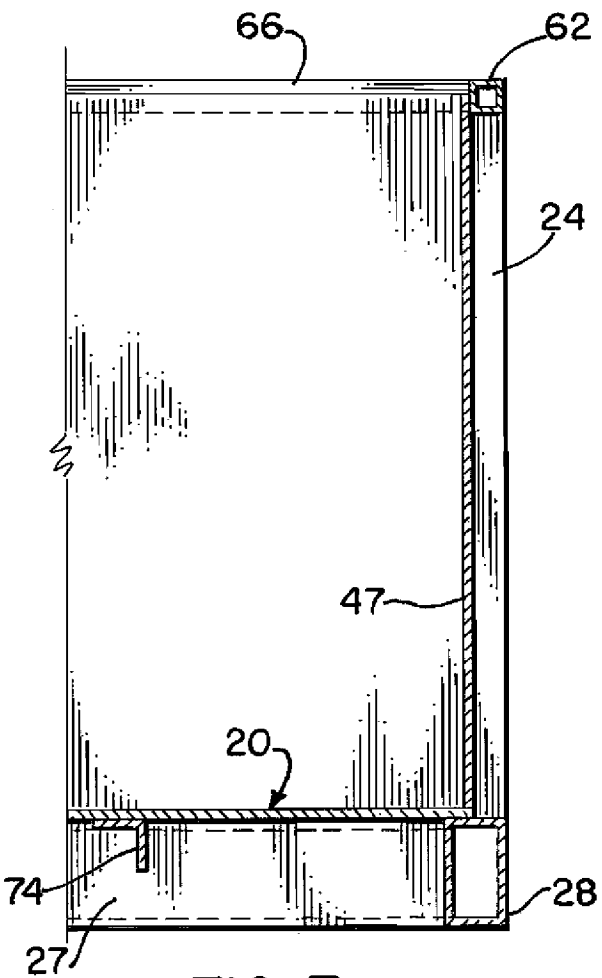
FIG. 7 is a sectional view taken along lines 7-7 of FIG. 2.
Figure 8:
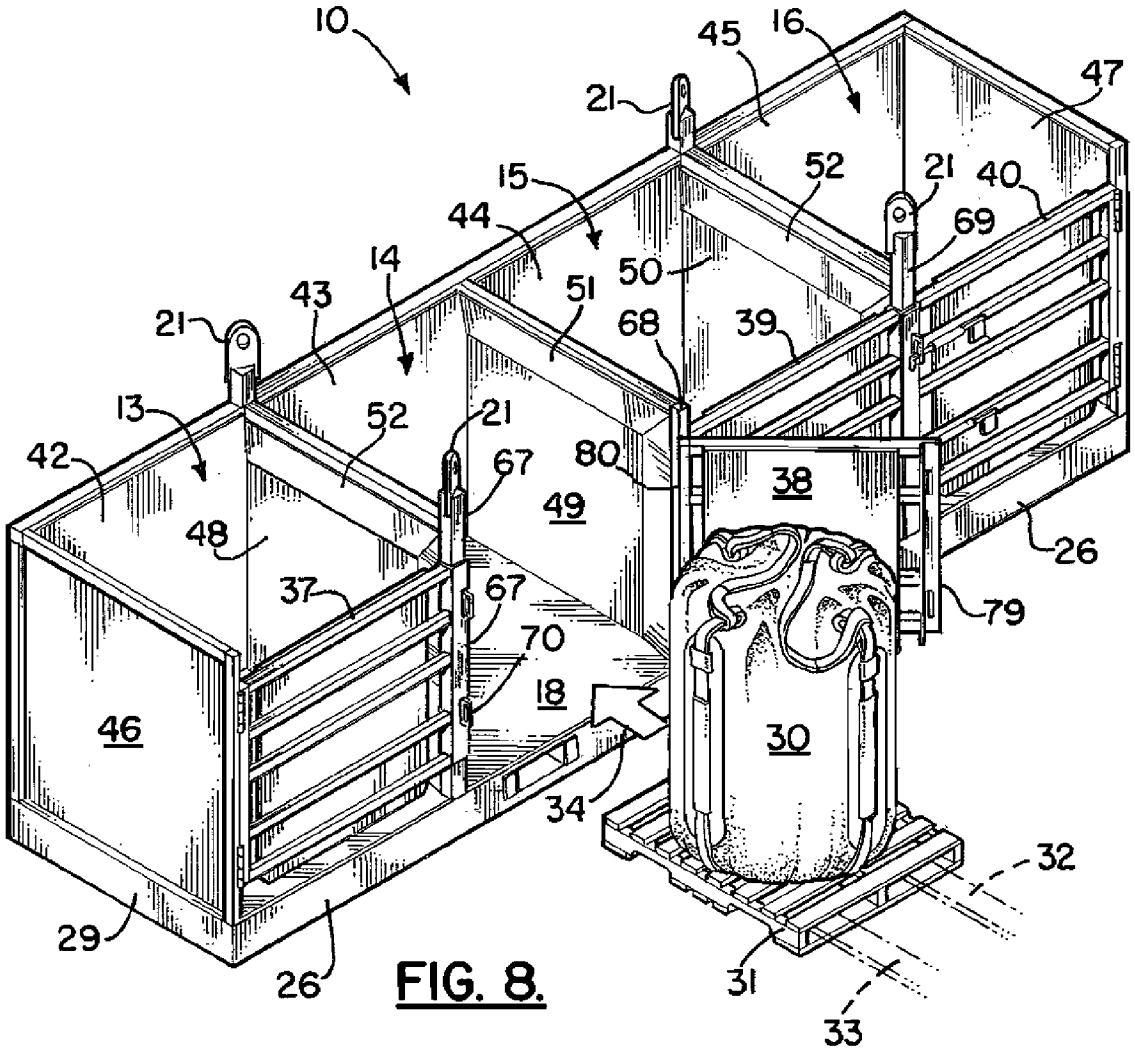
FIG. 8 is a perspective view of the preferred embodiment of the apparatus of the present invention.
Figure 9:
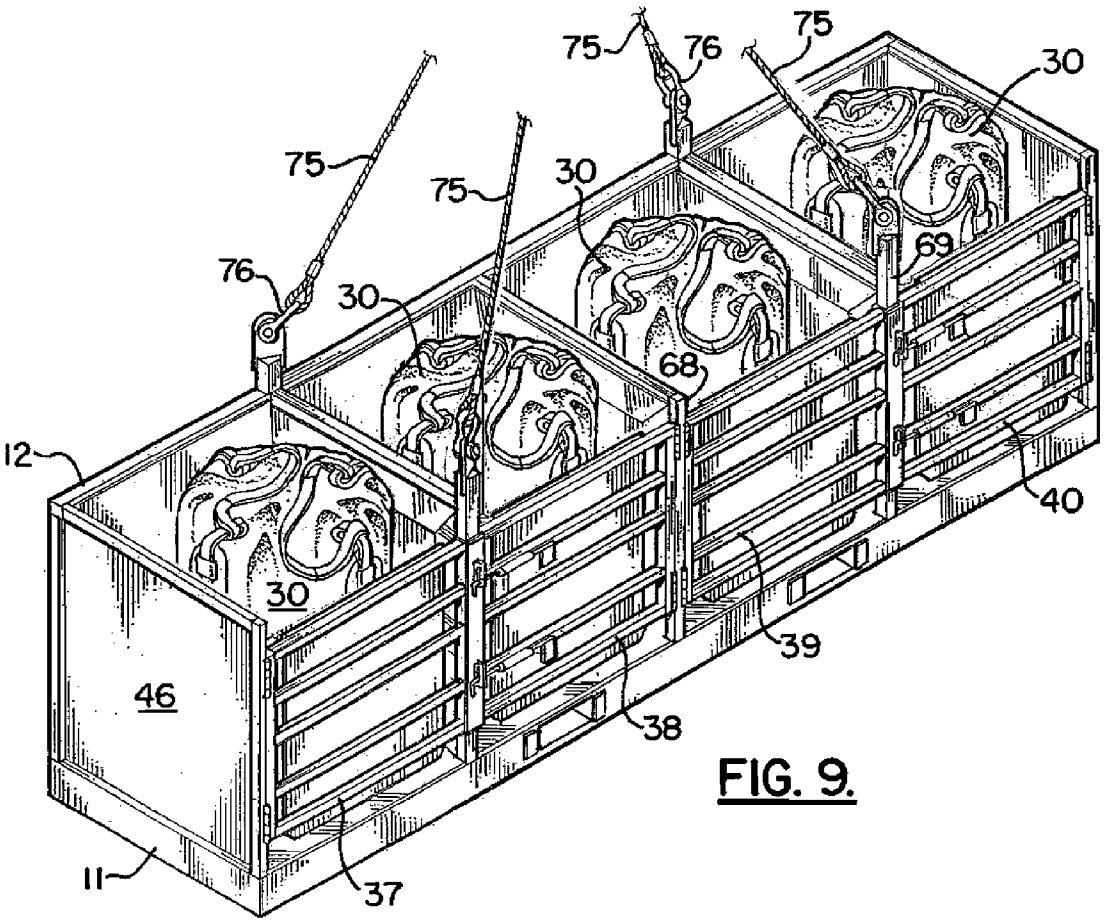
FIG. 9 is a perspective view of the preferred embodiment of the apparatus of the present invention.

FIGS. 1-9 show the preferred embodiment of the apparatus of the present invention, designated generally by the numeral 10. Bulk bag transport apparatus 10 has a bottom portion 11, a top portion 12 and a plurality of bays or sections 13, 14, 15, 16. Each bay or section is configured to carry a bulk bag 30 as shown in FIGS. 8 and 9. Each bay or section 13-16 provides a floor upon which a bulk bag 30 can rest. The bay or section 13 has floor 17. The bay or section 14 has floor 18. The bay or section 15 has floor 19. The bay or section 16 has floor 20.

Figure 1:
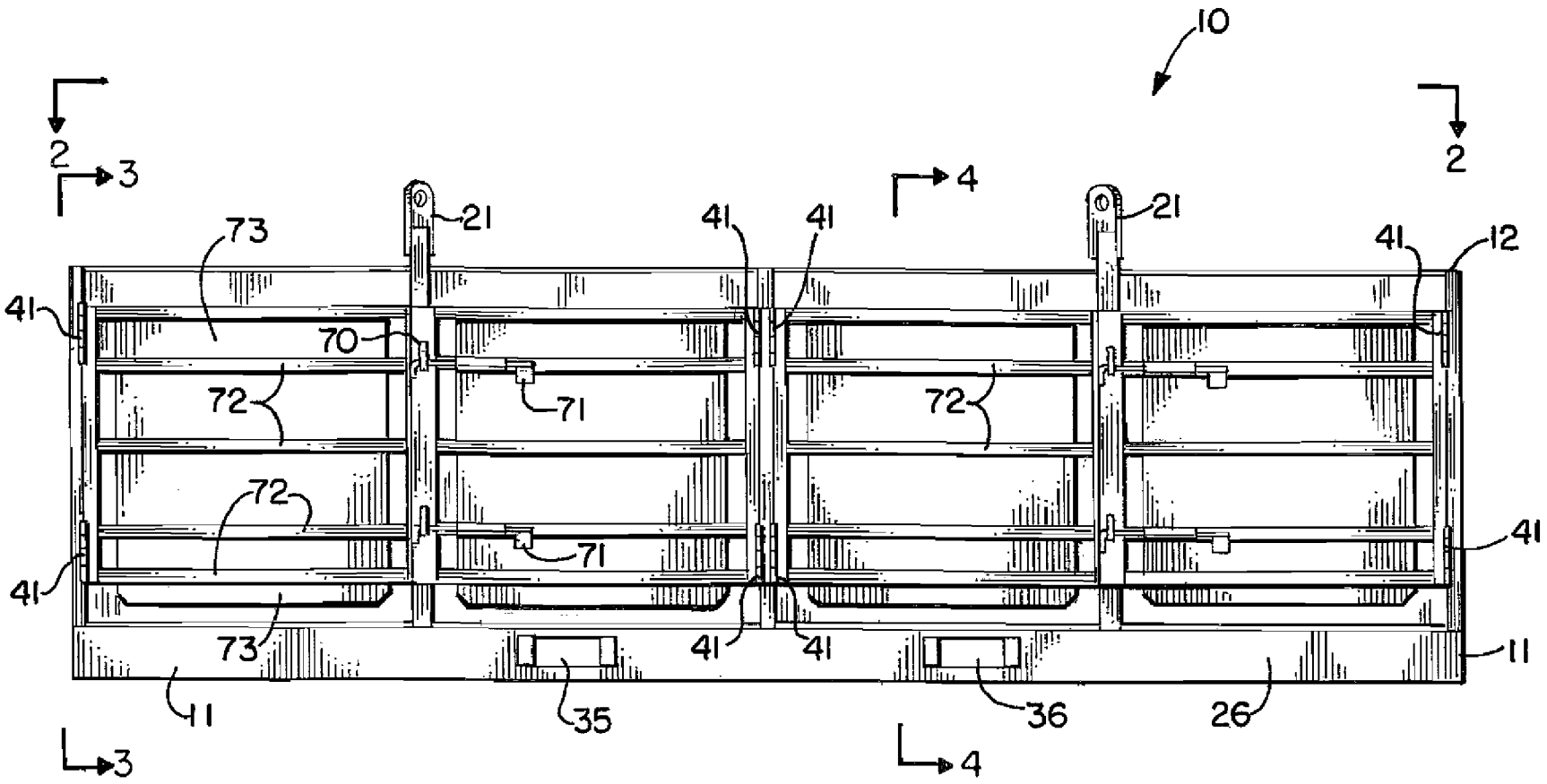
FIG. 1 is an elevation view of the preferred embodiment of the apparatus of the present invention.
Figure 2:
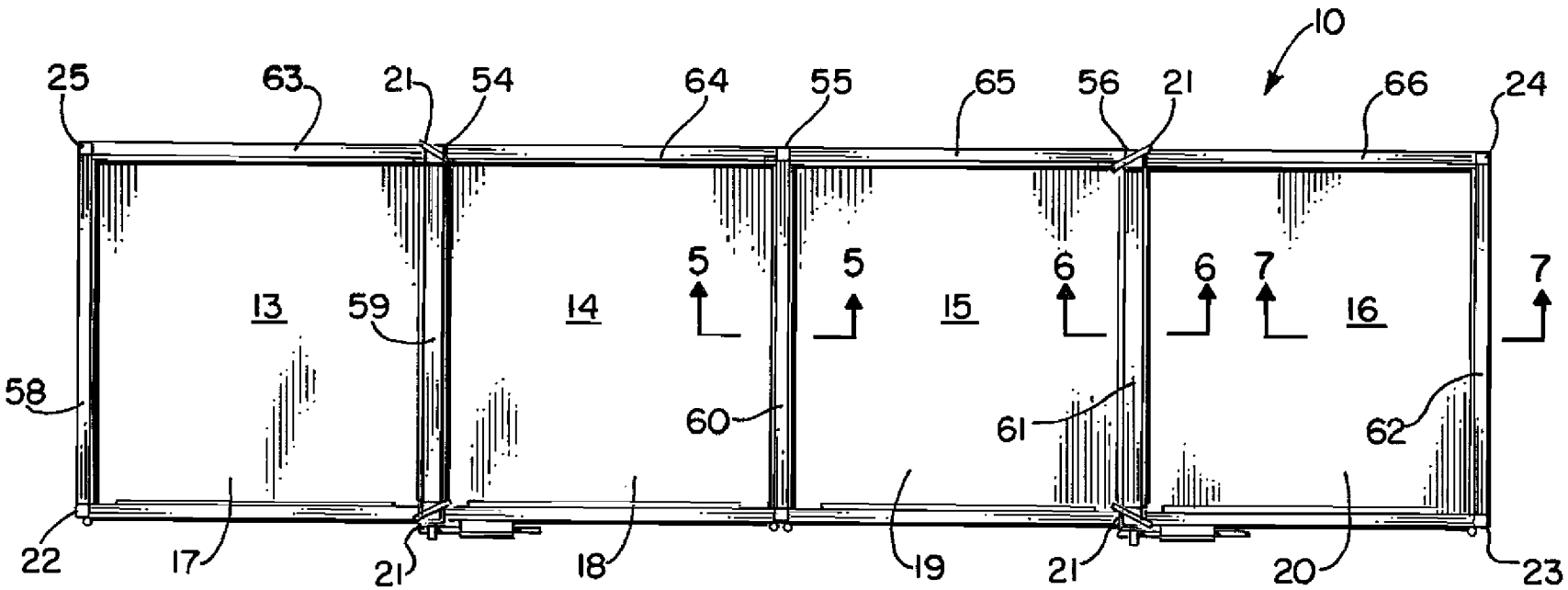
FIG. 2 is a top, plan view of the preferred embodiment of the apparatus of the present invention taken along lines 2-2 of FIG. 1.
Figure 4:
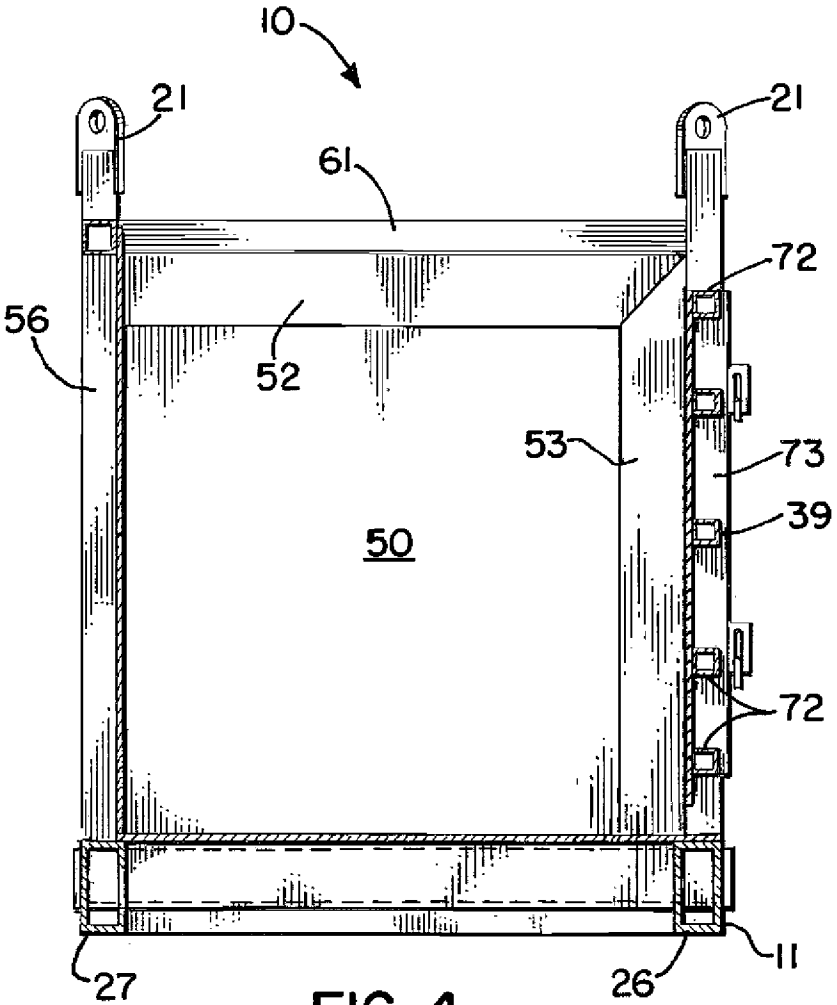
FIG. 4 is a sectional perspective view of the preferred embodiment of the apparatus of the present invention, taken along lines 4-4 of FIG. 1.
Figure 3:
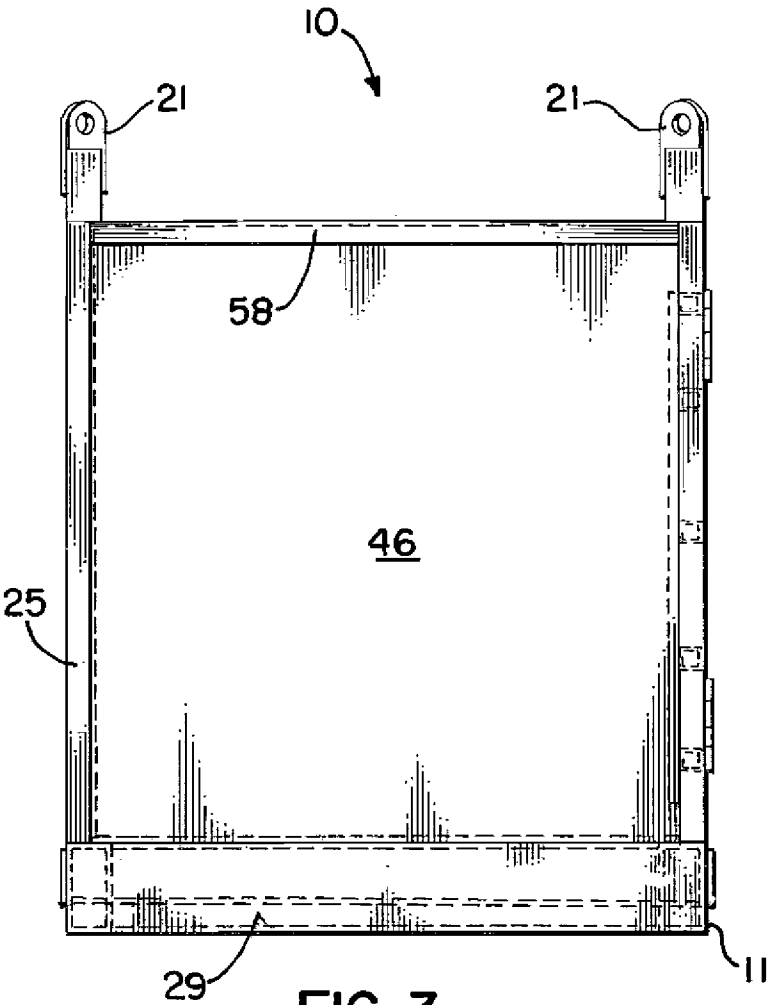
FIG. 3 is an end view of the preferred embodiment of the apparatus of the present invention taken along lines 3-3 of FIG. 1.

Four lifting eyes 21 are placed on top portion 12. Each lifting eye 21 is adapted to be connected to rigging such as a shackle 76 and sling 75. These slings and shackles are then connected to a lifting device such as a crane. The apparatus 10 of the present invention can also be lifted with a fork lift, providing fork lift tine sockets 35, 36 as shown in FIG. 1. When adding a bulk bag 30 to the apparatus 10, either a fork lift or a crane can be used to add the bulk bag. The bulk bag 30 can either be lowered by a crane using rigging that includes for example slings 75 and shackle 76 or a fork lift having tines 32, 33 can be used to lift a pallet 31 that carries a bulk bag 30 as shown in FIG. 8. The arrow 34 in FIG. 8 schematically illustrates transfer of a pallet 31 holding a bulk bag 30. The arrow 34 indicates that a fork lift having tines 32, 33 engages and lifts the pallet 31 and the contained bulk bag 30 and then transfers the pallet 31 and its bulk bag 30 to floor 18 of bay or section 14. Because the apparatus 10 provides bays or sections 13-16 with open tops, bulk bags 30 can be added vertically from above apparatus 10. Further, because of specially configured walls and gates, the bulk bags 30 can be removed either by lifting the bag 30 vertically from its bay or section 13-16 or by pulling the bag 30 upon a pallet 31 from the bay 13-16, in any case without risk of tearing or otherwise damaging the bag 30.

Figure 6:
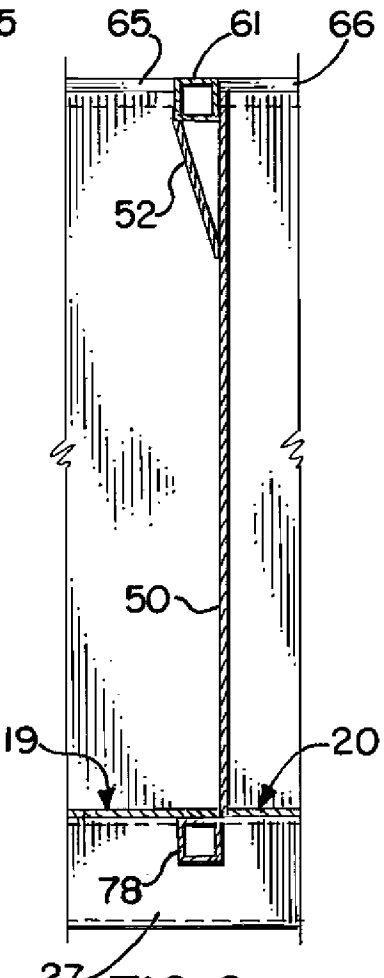
FIG. 6 is a sectional view of the preferred embodiment of the apparatus of the present invention, taken along lines 6-6 of FIG. 2.
Figure 5:
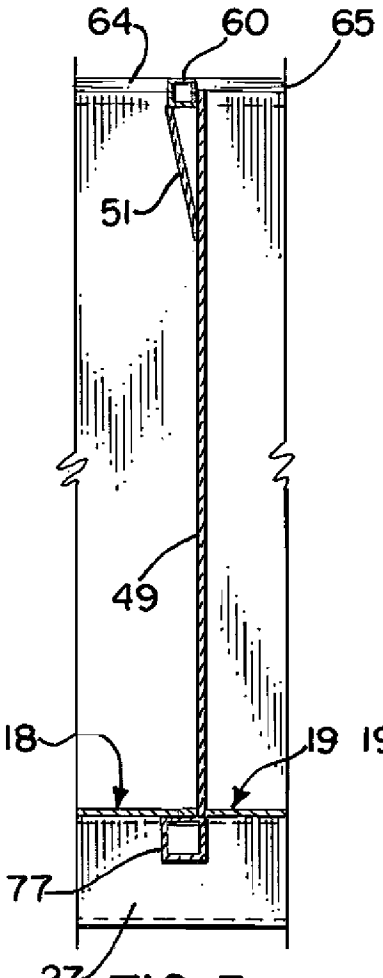
FIG. 5 is a sectional view of the of the preferred embodiment of the apparatus of the present invention, taken along lines 5-5 of FIG. 2.

The apparatus 10 is a structural liftable transportable frame that includes corner columns 22-25 which are supported upon a base that is comprised of front perimeter beam 26, rear perimeter beam 27, side perimeter beam 28, and side perimeter beam 29. Further, the perimeter beams 26-29 support the floors 17-20 which are welded thereto, the floors 17-20 and perimeter beams 26-29 being of welded steel construction for example. Transverse beams extend laterally from front perimeter beam 26 to rear perimeter beam 27. These transverse beams that are part of lower section 11 include transverse beam 77, transverse beam 78, or an intermediate floor beam 74 such as shown in FIGS. 5-7. These intermediate beams 74, 77, 78 span between the front perimeter beam 26 and the rear perimeter beam 27 at least at a position below each of the interior walls 48, 49, 50.

Each bay 13-16 is thus defined by a floor section 17-20, a wall 46, 47, 48, 49, 50 and a gate 37-40. Each gate 37-40 attaches to a front intermediate column 67, 68, 69 at a provided hinge or hinges 41. Each bay 13-16 is also defined by a rear wall section 42, 43, 44 or 45.

As shown in FIGS. 4-6 and 8-9, specially configured angled plate sections 51, 52, 53 are placed to prevent damage to any bulk bag 30 during either placement within a selected bay 13-16 or during removal of a bulk bag 30 from a selected bay 13-16. For example, in FIG. 4, the interior wall 50 is provided with an angled plate section 52 that extends generally horizontally across the upper end portion of interior wall 50. Another angled plate section 53 extends generally vertically along the forward edge of interior wall 50 at a position next to gate 39. These angled plate sections 51-53 extend from an interior wall 48, 49, 50 to an upper transverse beam such as 60 or 61 shown in FIGS. 5 and 6 so that when a bag 30 is lifted upwardly, the bag is deflected by plate section 51, 52, 53 so that it does not engage or become damaged by an upper transverse beam 60, 61 or a gate 37-40.

The apparatus 10 includes a plurality of intermediate columns 54, 55, 56. Upper transverse beams 58-62 extend transversely, helping to divide the bays 13-16 apart.

Upper rear beams 63-66 are provided as are front intermediate columns 67, 68, 69. Latch parts are provided on the doors or gates 37-40 which engage corresponding latch parts on an intermediate column. In FIG. 1, the latch part 71 is provided on each gate 37-40. The latch part 70 is provided on each column for enabling a connection to be made with the latch part 71 of the gate.

Each gate can be reinforced with a plurality of horizontal beams 72. Each gate has vertical beams 79, 80. Each gate 37-40 is provided with gate plate sections 73.

Figure 10:
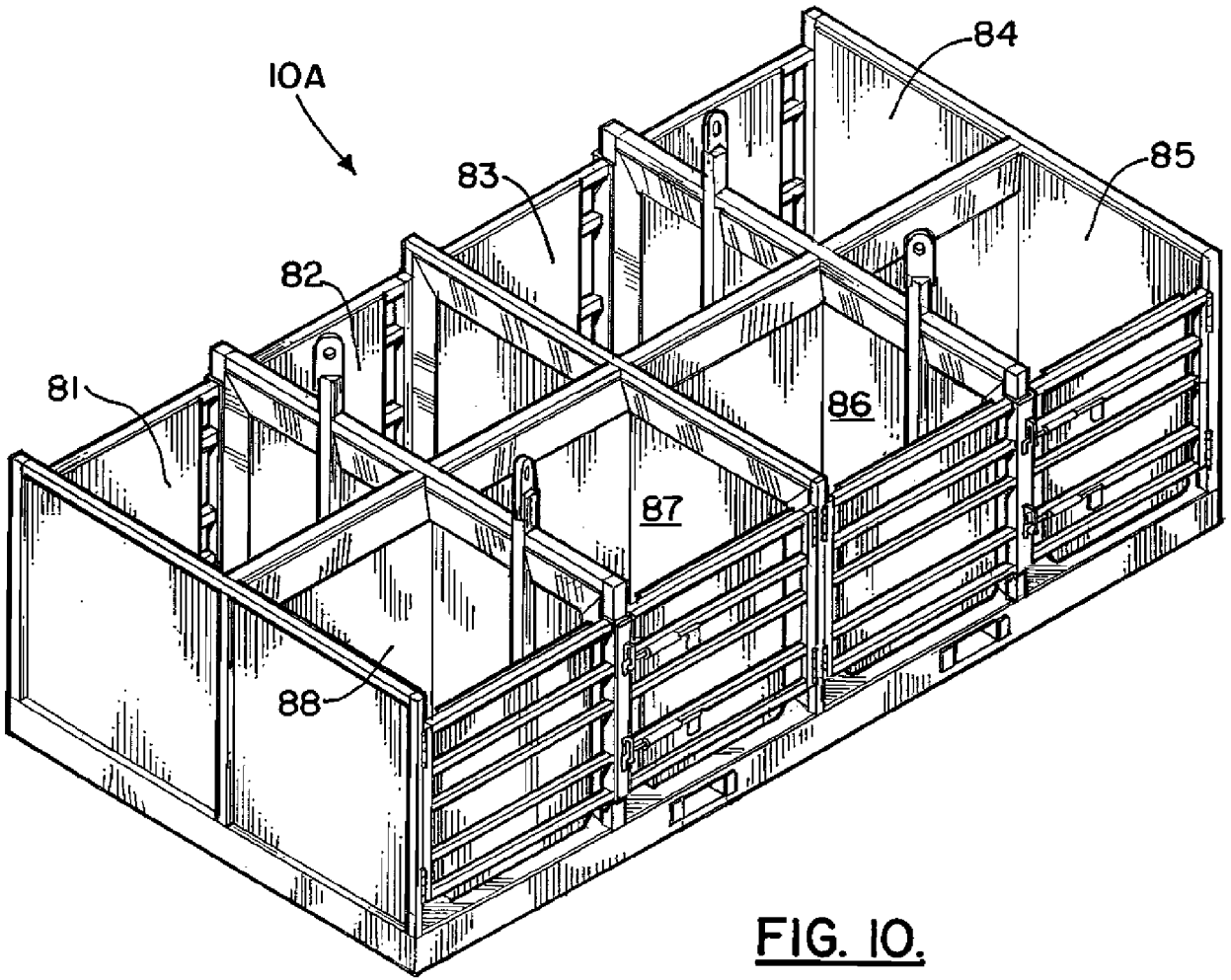
FIG. 10 is a perspective view of an alternate embodiment of the apparatus of the present invention.

In FIG. 10, the transport apparatus 10A is similar in construction to the transport apparatus 10 of FIGS. 1-9, but provides eight (8) bays 81-88.

The following is a list of parts and materials suitable for use in the present invention:

PARTS LIST:

| Parts Number | Description |
|---|---|
| 10 | apparatus |
| 10A | apparatus |
| 11 | bottom portion |
| 12 | top portion |
| 13 | bay/section |
| 14 | bay/section |
| 15 | bay/section |
| 16 | bay/section |
| 17 | floor |
| 18 | floor |
| 19 | floor |
| 20 | floor |
| 21 | lifting eye |
| 22 | corner column |
| 23 | corner column |

-continued

PARTS LIST:

| Parts Number | Description |
|---|---|
| 24 | corner column |
| 25 | corner column |
| 26 | front perimeter beam |
| 27 | rear perimeter beam |
| 28 | side perimeter beam |
| 29 | side perimeter beam |
| 30 | bulk bag |
| 31 | pallet |
| 32 | fork lift tine |
| 33 | fork lift tine |
| 34 | arrow |
| 35 | socket |
| 36 | socket |
| 37 | gate |
| 38 | gate |
| 39 | gate |
| 40 | gate |
| 41 | hinge |
| 42 | rear wall section |
| 43 | rear wall section |
| 44 | rear wall section |
| 45 | rear wall section |
| 46 | end wall |
| 47 | end wall |
| 48 | interior wall |
| 49 | interior wall |
| 50 | interior wall |
| 51 | angled plate section |
| 52 | angled plate section |
| 53 | angled plate section |
| 54 | intermediate column |
| 55 | intermediate column |
| 56 | intermediate column |
| 58 | upper transverse beam |
| 59 | upper transverse beam |
| 60 | upper transverse beam |
| 61 | upper transverse beam |
| 62 | upper transverse beam |
| 63 | upper rear beam |
| 64 | upper rear beam |
| 65 | upper rear beam |
| 66 | upper rear beam |
| 67 | front intermediate column |
| 68 | front intermediate column |
| 69 | front intermediate column |
| 70 | latch part |
| 71 | latch part |
| 72 | gate horizontal beam |
| 73 | gate plate section |
| 74 | intermediate floor beam |
| 75 | sling |
| 76 | shackle |
| 77 | transverse beam |
| 78 | transverse beam |
| 79 | vertical beam |
| 80 | vertical beam |
| 81 | bay/section |
| 82 | bay/section |
| 83 | bay/section |
| 84 | bay/section |
| 85 | bay/section |
| 86 | bay/section |
| 87 | bay/section |
| 88 | bay/section |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A bulk bag transport apparatus comprising:

a) a receptacle having a plurality of side walls, a bottom wall, an interior, and an open top surrounded by an upper edge;

b) a base supporting the bottom wall, said base including peripheral beams and a plurality of transverse bottom beams that segment the interior into a plurality of bulk bag holding sectors;

c) each side wall being reinforced with a plurality of inclined beams that each join to a said transverse bottom beam of said base;

d) a plurality of upper peripheral beams attached to the upper edge of the receptacle, each inclined beam being structurally joined to a said upper peripheral beam;

e) a plurality of lifting eyes, each mounted to a said inclined beam and forming an acute angle therewith;

f) a lifting harness that includes slings that connect to the lifting eyes; and g) each sidewall having a horizontal flange that enables one of said receptacles to be stacked upon another of said receptacles, wherein the upper peripheral beam of one said receptacle engages and supports the horizontal flange of another said receptacle.

2. The bulk bag transport apparatus of claim 1 wherein a pair of the slings are attached to said lifting eyes at one said side wall of the receptacle, another pair of the slings being attached to said lifting eyes on the other said side wall of the receptacle.

3. The bulk bag transport apparatus of claim 2 wherein each pair of the slings attaches to a lifting ring.

4. The bulk bag transport apparatus of claim 3 further comprising a rigging hanger in between two padeyes for holding rigging when the receptacle is not being lifted.

5. The bulk bag transport apparatus of claim 1 wherein each horizontal flange is positioned in between a lower peripheral beam and a said upper peripheral beam.

6. The bulk bag transport apparatus of claim 1 wherein each horizontal flange connects structurally to a pair of said inclined beams.

7. The bulk bag transport apparatus of claim 1 wherein there are at least three of said bulk bag holding sectors.

8. The bulk bag transport apparatus of claim 1 wherein there are at least four of said bulk bag holding sectors.

9. The bulk bag transport apparatus of claim 1 wherein one or more of the sidewalls are inclined.

10. The bulk bag transport apparatus of claim 1 wherein all of the sidewalls are inclined.

11. A bulk bag transport apparatus comprising:

a) a receptacle having a plurality of side walls, a bottom wall, an interior, and an open top surrounded by an upper edge;

b) a base supporting the bottom wall, said base including peripheral beams and a plurality of transverse bottom beams that segment the interior into a plurality of bulk bag holding sectors;

c) each side wall being reinforced with a plurality of inclined beams that each join to a said transverse bottom beam of said base;

d) a plurality of upper peripheral beams attached to the upper edge of the receptacle, wherein each inclined beam is structurally joined to a said upper peripheral beam;

e) a plurality of lifting eyes mounted to the receptacle for enabling the receptacle to be lifted;

f) a lifting harness that includes slings that connect to the lifting eyes; and g) each sidewall having a horizontal flange that enables one of said receptacles to be stacked upon another of said receptacles, wherein the upper peripheral beam of one said receptacle engages and supports the horizontal flange of another said receptacle.

12. The bulk bag transport apparatus of claim 11 wherein each lifting eye is attached to a said inclined beam.

13. The bulk bag transport apparatus of claim 12 wherein each lifting eye is attached to both a said inclined beam and a said peripheral beam.

14. The bulk bag transport apparatus of claim 11 wherein each lifting eye is attached to a said peripheral beam.

15. The bulk bag transport apparatus of claim 11 wherein a pair of the slings are attached to said lifting eyes at one said side wall of the receptacle, another pair of the slings being attached to said lifting eyes on the other said side wall of the receptacle.

16. The bulk bag transport apparatus of claim 15 wherein each pair of the slings attaches to a lifting ring.

17. The bulk bag transport apparatus of claim 16 further comprising a rigging hanger in between two padeyes for holding rigging when the receptacle is not being lifted.

18. The bulk bag transport apparatus of claim 11 wherein each horizontal flange is positioned in between a lower peripheral beam and a said upper peripheral beam.

19. The bulk bag transport apparatus of claim 11 wherein each horizontal flange connects structurally to a pair of said inclined beams.

20. A bulk bag transport apparatus comprising:

a) a receptacle having a plurality of side walls, a bottom wall, an interior, and an open top surrounded by an upper edge;

b) a base supporting the bottom wall, said base including peripheral beams and transverse bottom beams that segment the interior into a plurality of bulk bag holding sectors;

c) each side wall being reinforced with a plurality of inclined beams that each join to a said transverse bottom beam;

d) a plurality of upper peripheral beams attached to the upper edge of the receptacle, each inclined beam being structurally joined to a said peripheral beam;

e) a plurality of lifting eyes mounted to the receptacle for enabling the receptacle to be lifted; and f) each sidewall having a horizontal flange that enables one of said receptacles to be stacked upon another of said receptacles, wherein the upper peripheral beam of one said receptacle engages and supports the horizontal flange of another said receptacle.

* * * * *